US011762328B2

(12) United States Patent
Sato et al.

(10) Patent No.: US 11,762,328 B2
(45) **Date of Patent: *Sep. 19, 2023**

(54) IMAGE FORMING APPARATUS

(71) Applicant: BROTHER KOGYO KABUSHIKI KAISHA, Nagoya (JP)

(72) Inventors: Shougo Sato, Seto (JP); Kazuna Taguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/937,478

(22) Filed: Oct. 3, 2022

(65) Prior Publication Data

US 2023/0024209 A1 Jan. 26, 2023

Related U.S. Application Data

(63) Continuation of application No. 17/492,888, filed on Oct. 4, 2021, now Pat. No. 11,493,877.

(30) Foreign Application Priority Data

Oct. 6, 2020 (JP) ..... 2020-169443

(51) Int. Cl.
*G03G 21/16* (2006.01)
*G03G 21/18* (2006.01)

(52) U.S. Cl.
CPC ..... *G03G 21/1671* (2013.01); *G03G 21/1623* (2013.01); *G03G 21/1676* (2013.01); (Continued)

(58) Field of Classification Search
CPC ..... G03G 21/1623; G03G 21/1671; G03G 21/1676; G03G 21/1821; G03G 21/1825; (Continued)

(56) References Cited

U.S. PATENT DOCUMENTS 11,493,877 B2 * 11/2022 Sato ..... G03G 21/1671
2007/0217818 A1 9/2007 Shiraki et al.
(Continued)

FOREIGN PATENT DOCUMENTS

JP 2009-139495 A 6/2009
JP 2012-155266 A 8/2012
JP 2016-004115 A 1/2016

*Primary Examiner* — Sophia S Chen
(74) *Attorney, Agent, or Firm* — Merchant & Gould P.C.

(57) ABSTRACT

An image forming apparatus includes a body housing, a drawer movable between an accommodated position and a drawn position, a drum cartridge including a photoconductor drum, a developing cartridge including a developing roller, and a belt located above the photoconductor drum, and the drawer is located at the accommodated position. The drum cartridge includes a moving member movable, with respect to the photoconductor drum, between (i) a first position which is a position at which the moving member is not opposed to the developing cartridge mounted on the drum cartridge and is opposed to a circumferential surface of the photoconductor drum and (ii) a second position which is a position at which the moving member is not opposed to the circumferential surface of the photoconductor drum and is opposed to the developing cartridge mounted on the drum cartridge.

13 Claims, 9 Drawing Sheets

(52) U.S. Cl.
CPC ..... *G03G 21/1821* (2013.01); *G03G 21/1825* (2013.01); *G03G 2221/1869* (2013.01)

(58) Field of Classification Search
CPC ... G03G 2221/1654; G03G 2221/1684; G03G 2221/1869
See application file for complete search history.

(56) References Cited

U.S. PATENT DOCUMENTS

| | | | | |
|---|---|---|---|---|
| 2009/0142092 | A1 | 6/2009 | Sato | |
| 2010/0074646 | A1* | 3/2010 | Miyahara | G03G 21/169 399/99 |
| 2012/0195628 | A1 | 8/2012 | Kato | |
| 2015/0362888 | A1 | 12/2015 | Itabashi | |
| 2018/0095418 | A1* | 4/2018 | Sato | G03G 21/1821 |
| 2019/0302687 | A1 | 10/2019 | Miyoshi et al. | |
| 2022/0066383 | A1 | 3/2022 | Sato | |
| 2022/0100123 | A1 | 3/2022 | Sato et al. | |

* cited by examiner

IMAGE FORMING APPARATUS

CROSS REFERENCE TO RELATED APPLICATION

The present application in a continuation of U.S. patent application Ser. No. 17/492,888, filed Oct. 4, 2021, now U.S. Pat. No. 11,493,877, which claims priority to Japanese Patent Application No. 2020-169443, which was filed on Oct. 6, 2020, the disclosures of which are incorporated herein by reference in their entirety.

BACKGROUND

The following disclosure relates to an image forming apparatus.

An image forming apparatus includes a body housing, a drawer, a drum cartridge, and a belt in related art. The drawer is movable between an accommodated position and a drawn position. The drawer is accommodated in the body housing in a state in which the drawer is located at the accommodated position. The drawer is drawn out from the body housing in a state in which the drawer is located at the drawn position. The drum cartridge includes a photoconductor drum. The drum cartridge is mountable on the drawer in a state in which the drawer is located at the drawn position. The belt is located above the photoconductor drum in a state in which the drum cartridge is mounted on the drawer and the drawer is located at the accommodated position.

SUMMARY

In the image forming apparatus described above, a circumferential surface of the photoconductor drum is exposed in a state in which the drum cartridge is mounted on the drawer and the drawer is located at the drawn position.

Accordingly, the circumferential surface of the photoconductor drum may be scratched during replacement work of the drum cartridge.

An aspect of the disclosure relates to an image forming apparatus and a drum cartridge capable of protecting a circumferential surface of a photoconductor drum in a structure in which a belt is located above the photoconductor drum in a state in which the drum cartridge is mounted on a drawer and the drawer is located at the accommodated position.

In one aspect of the disclosure, an image forming apparatus, comprises a body housing, a drawer movable between an accommodated position which is a position at which the drawer is accommodated in the body housing and a drawn position which is a position at which the drawer is drawn out from the body housing, a drum cartridge including a photoconductor drum and mountable on the drawer in a state in which the drawer is located at the drawn position, a developing cartridge including a developing roller and mountable on the drum cartridge in a state in which the drum cartridge is removed from the drawer, and a belt located above the photoconductor drum in a state in which the drum cartridge is mounted on the drawer and the drawer is located at the accommodated position. The drum cartridge includes a moving member movable, with respect to the photoconductor drum, between (i) a first position which is a position at which the moving member is not opposed to the developing cartridge mounted on the drum cartridge and is opposed to a circumferential surface of the photoconductor drum and (ii) a second position which is a position at which the moving member is not opposed to the circumferential surface of the photoconductor drum and is opposed to the developing cartridge mounted on the drum cartridge.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Outline of Image Forming Apparatus 1

An outline of an image forming apparatus 1 will be explained with reference to FIG. 1 to FIG. 3.

Figure 1:
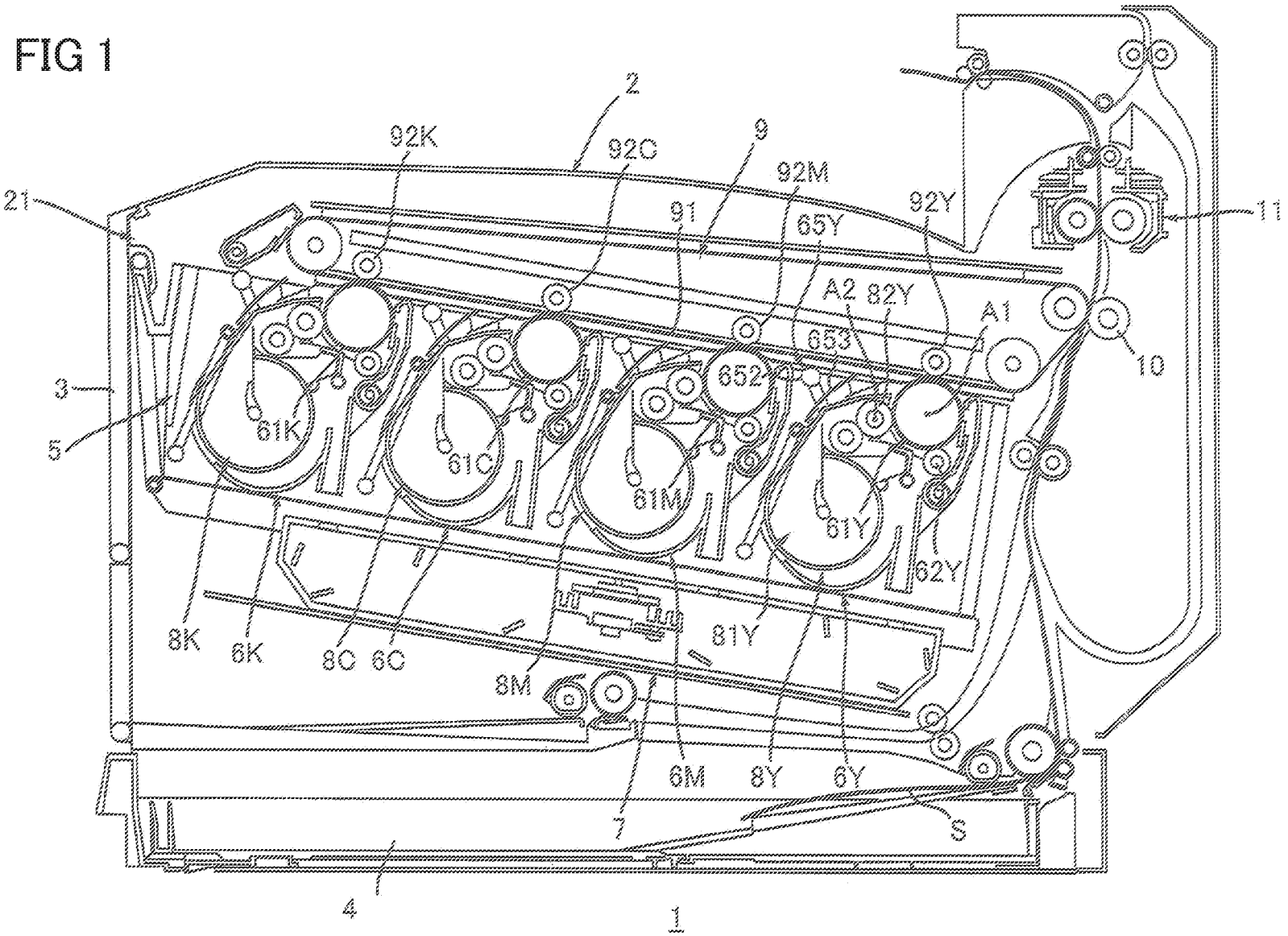
FIG. 1 is a schematic structural view of an image forming apparatus.

As illustrated in FIG. 1, the image forming apparatus 1 includes a body housing 2, a cover 3, a sheet container 4, a drawer 5, a plurality of drum cartridges 6Y, 6M, 6C, and 6K, an exposing device 7, a plurality of developing cartridges 8Y, 8M, 8C, and 8K, a belt unit 9, a transfer roller 10, and a fixing device 11.

Body Housing 2

The body housing 2 accommodates the sheet container 4, the drawer 5, the plurality of drum cartridges 6K, 6C, 6M, and 6Y, the exposing device 7, the plurality of developing cartridges 8Y, 8M, 8C, and 8K, the belt unit 9, the transfer roller 10, and the fixing device 11. The body housing 2 includes an opening 21.

Cover 3

Figure 2:
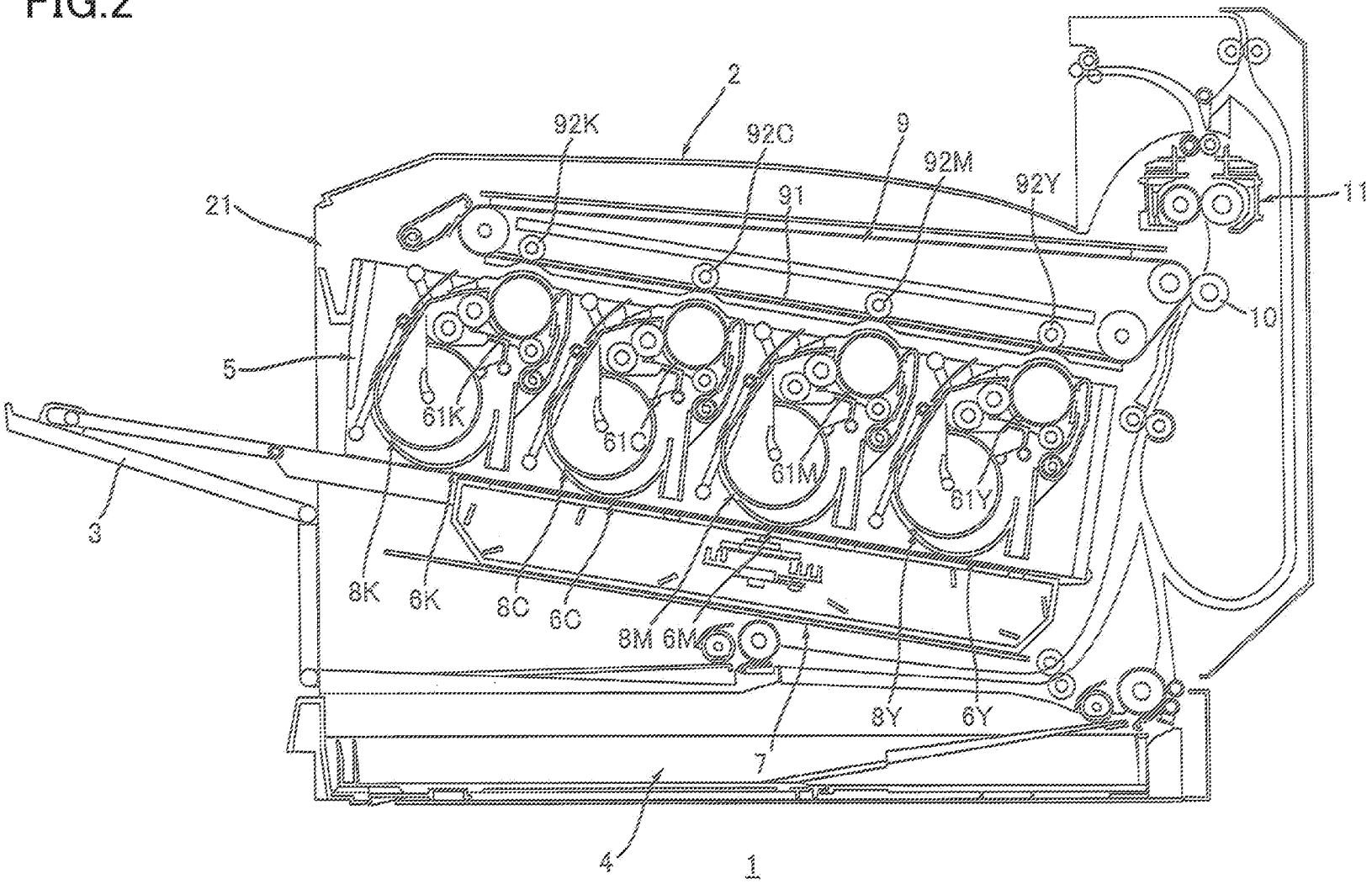
FIG. 2 is a view of the image forming apparatus illustrated in FIG. 1, illustrating a state in which a cover is located at an open position and a drawer is located at a second accommodated position.

The cover 3 is movable between a closed position (see FIG. 1) and an open position (see FIG. 2). As illustrated in FIG. 1, when the cover 3 is located at the closed position, the cover 3 closes the opening 21. As illustrated in FIG. 2, when the cover is located at the open position, the opening 21 opens.

Sheet Container 4

As illustrated in FIG. 1, the sheet container 4 can contain a sheet S. The sheet S in the sheet container 4 is conveyed toward the transfer roller 10.

Drawer 5

Figure 3:
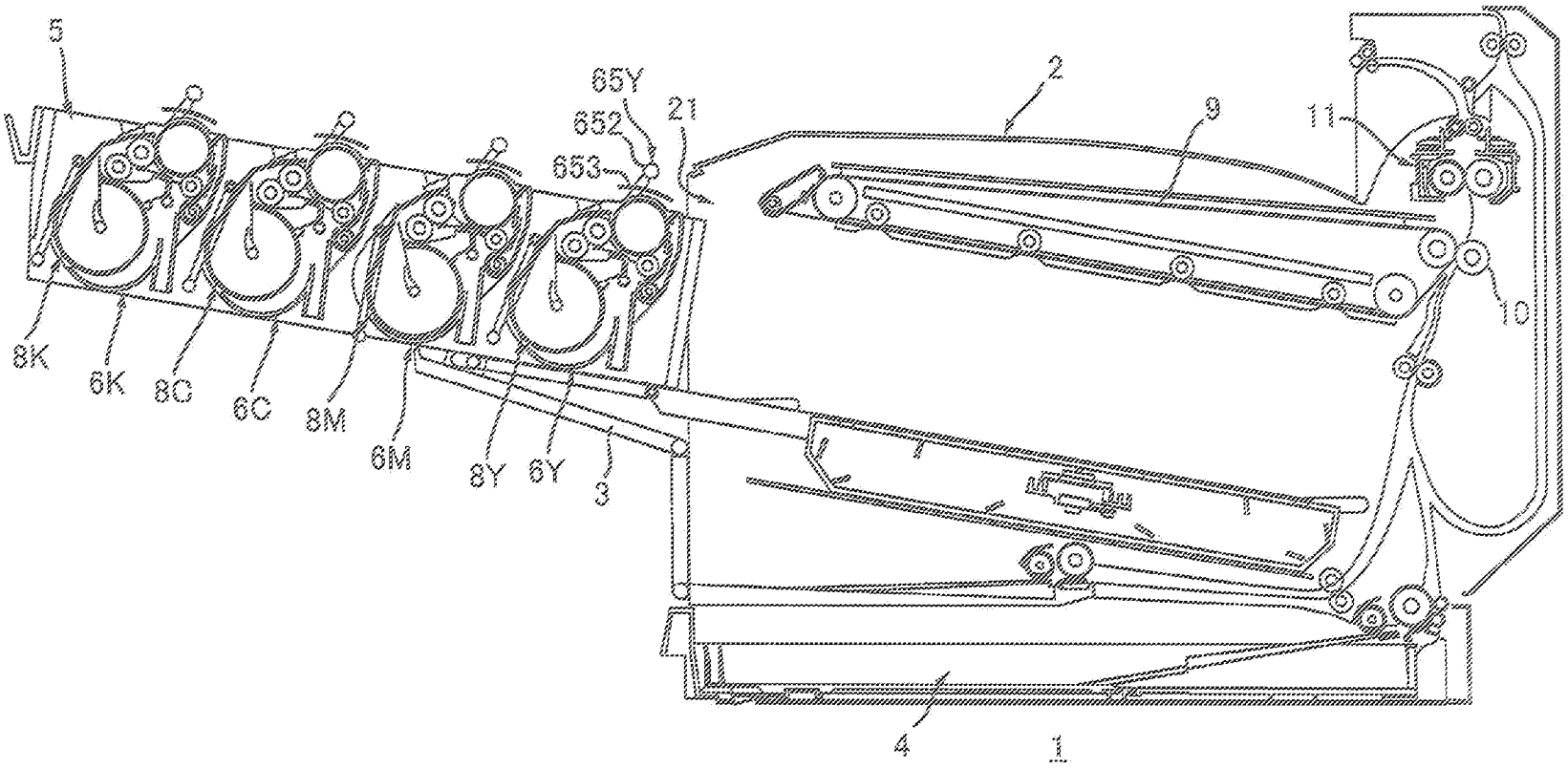
FIG. 3 is a view of the image forming apparatus illustrated in FIG. 1, illustrating a state in which the cover is located at the open position and the drawer is located at a drawn position.

As illustrated in FIG. 1 to FIG. 3, the drawer 5 is movable between an accommodated position (see FIG. 1) and a drawn position (see FIG. 3).

Specifically, as illustrated in FIG. 1 and FIG. 2, the drawer 5 moves from the accommodated position (see FIG. 1) to a second accommodated position (see FIG. 2) in conjunction with movement of the cover 3 from the closed position (see FIG. 1) to the open position (see FIG. 2). The drawer 5 is located at the accommodated position in a state in which the cover 3 is located at the closed position. The drawer 5 is located at the second accommodated position in a state in which the cover 3 is located at the open position. The entire of the drawer 5 is accommodated in the body housing 2 in states in which the drawer is located at the accommodated position and in which the drawer is located at the second accommodated position. When the drawer 5 moves from the accommodated position to the second accommodated position, the drawer 5 moves away from the belt unit 9.

It is noted that the drawer 5 moves from the second accommodated position (see FIG. 2) to the accommodated position (see FIG. 1) in conjunction with the movement of the cover 3 from the open position (see FIG. 2) to the closed position (see FIG. 1). When the drawer 5 moves from the second accommodated position to the accommodated position, the drawer 5 comes close to the belt unit 9.

Then, as illustrated in FIG. 2 and FIG. 3, the drawer 5 is movable through the opening 21 between the second accommodated position (see FIG. 2) and the drawn position (see FIG. 3) in the state in which the cover 3 is located at the open position. The drawer 5 is movable in a direction in which photoconductor drums 61Y, 61M, 61C, and 61K (see FIG. 1) are arranged. The photoconductor drums 61Y, 61M, 61C, and 61K will be explained later. As illustrated in FIG. 3, at least a part of the drawer 5 is drawn out from the body housing 2 in a state in which the cover 3 is located at the open position and the drawer 5 is located at the drawn position.

Drum Cartridges 6Y, 6M, 6C, and 6K

Each of the drum cartridges 6Y, 6M, 6C, and 6K is mountable on the drawer 5 in a state in which the drawer 5 is located at the drawn position. Each of the drum cartridges 6Y, 6M, 6C, and 6K is removable from the drawer 5 in a state in which each of the respective drum cartridges 6Y, 6M, 6C, and 6K is mounted on the drawer 5 and the drawer 5 is located at the drawn position.

As illustrated in FIG. 1, the drum cartridge 6Y includes the photoconductor drum 61Y and a charging device 62Y.

The photoconductor drum 61Y is rotatable about a drum axis A1. The drum axis A1 extends in a first direction. The photoconductor drum 61Y extends in the first direction.

The charging device 62Y charges the photoconductor drum 61Y. The charging device 62Y is a charging roller. The charging device 62Y may be a scorotron type charging device.

Each of the drum cartridges 6M, 6C, and 6K is explained similarly to the drum cartridge 6Y. Therefore, explanation for each of the drum cartridges 6M, 6C, and 6K is omitted.

Exposing Device 7

The exposing device 7 is located below the drawer 5 in the state in which the drawer 5 is located at the accommodated position. The exposing device 7 is located between the sheet container 4 and the drawer 5 in the state in which the drawer 5 is located at the accommodated position. The exposing device 7 can expose each of circumferential surfaces of the photoconductor drums 61Y, 61M, 61C, and 61K in a state in which the drum cartridges 6Y, 6M, 6C, and 6K are mounted on the drawer 5 and the drawer 5 is located at the accommodated position. In the embodiment, the exposing device 7 is a laser scanner unit. The exposing device 7 may be an exposing head having an LED array.

Developing Cartridges 8Y, 8M, 8C, and 8K

The developing cartridge 8Y is mountable on the drum cartridge 6Y in a state in which the drum cartridge 6Y is removed from the drawer 5. The developing cartridge 8Y is removable from drum cartridge 6Y in a state in which the developing cartridge 8Y is mounted on the drum cartridge 6Y and the drum cartridge 6Y is removed from the drawer 5. It is incapable of removing the developing cartridge 8Y from the drum cartridge 6Y in a state in which the developing cartridge 8Y is mounted on the drum cartridge 6Y and the drum cartridge 6Y is mounted on the drawer 5.

The developing cartridge 8Y includes a toner container 81Y and a developing roller 82Y.

The toner container 81Y is capable of containing toner supplied to the photoconductor drum 61Y. In other words, the developing cartridge 8Y is capable of containing the toner supplied to the photoconductor drum 61Y. The toner container 81Y is located below the developing roller 82Y in the state in which the developing cartridge 8Y is mounted on the drum cartridge 6Y and the drum cartridge 6Y is mounted on the drawer 5. The toner container 81Y is located below the photoconductor drum 61Y in the state in which the developing cartridge 8Y is mounted on the drum cartridge 6Y and the drum cartridge 6Y is mounted on the drawer 5.

The developing roller 82Y is capable of supplying toner in the developing cartridge 8Y to the photoconductor drum 61Y. The developing roller 82Y contacts the photoconductor drum 61Y in the state in which the developing cartridge 8Y is mounted on the drum cartridge 6Y. The developing roller 82Y may be capable of separating from the photoconductor drum 61Y. The developing roller 82Y extends in the first direction in the state in which the developing cartridge 8Y is mounted on the drum cartridge 6Y. The developing roller 82Y is rotatable about a developing axis A2. The developing axis A2 extends in the first direction in the state in which the developing cartridge 8Y is mounted on the drum cartridge 6Y.

Each of the developing cartridges 8M, 8C, and 8K is explained similarly to the developing cartridge 8Y. Therefore, explanation for each of the developing cartridges 8M, 8C, and 8K is omitted.

Belt Unit 9

The belt unit 9 is located above the photoconductor drums 61Y, 61M, 61C, and 61K in the state in which the drum cartridges 6Y, 6M, 6C, and 6K are mounted on the drawer 5 and the drawer 5 is located at the accommodated position. The belt unit 9 includes a belt 91 and a plurality of transfer rollers 92Y, 92M, 92C, and 92K. That is, the image forming apparatus 1 includes the belt 91.

The belt 91 is an intermediate transfer belt. The belt 91 is located above the photoconductor drums 61Y, 61M, 61C, and 61K in the state in which the drum cartridges 6Y, 6M, 6C, and 6K are mounted on the drawer 5 and the drawer 5 is located at the accommodated position. The photoconductor drums 61Y, 61M, 61C, and 61K contact the belt 91 in the state in which the drum cartridges 6Y, 6M, 6C, and 6K are mounted on the drawer 5 and the drawer 5 is located at the accommodated position. As illustrated in FIG. 2, the photoconductor drums 61Y, 61M, 61C, and 61K are spaced apart from the belt 91 in a state in which the drum cartridges 6Y, 6M, 6C, and 6K are mounted on the drawer 5 and the drawer 5 is located at the second accommodated position.

As illustrated in FIG. 1, the transfer roller 92Y transfers toner on the photoconductor drum 61Y to the belt 91 in the state in which the drum cartridges 6Y, 6M, 6C, and 6K are mounted on the drawer 5 and the drawer 5 is located at the accommodated position. The transfer roller 92M transfers toner on the photoconductor drum 61M to the belt 91. The transfer roller 92C transfers toner on the photoconductor drum 61C to the belt 91. The transfer roller 92K transfers toner on the photoconductor drum 61K to the belt 91.

Transfer Roller 10

The transfer roller 10 contacts the belt 91. The sheet S which has been accommodated in the sheet container 4 passes between the belt 91 and the transfer roller 10. At this time, the transfer roller 10 transfers toner on the belt 91 to the sheet S.

Fixing Device 11

The fixing device 11 heats and pressurizes the sheet S to which the toner is transferred to thereby fix the toner on the sheet S. The sheet S having passed through the fixing device 11 is discharged to an upper surface of the body housing 2.

Details of Drum Cartridge 6Y

Figure 4:
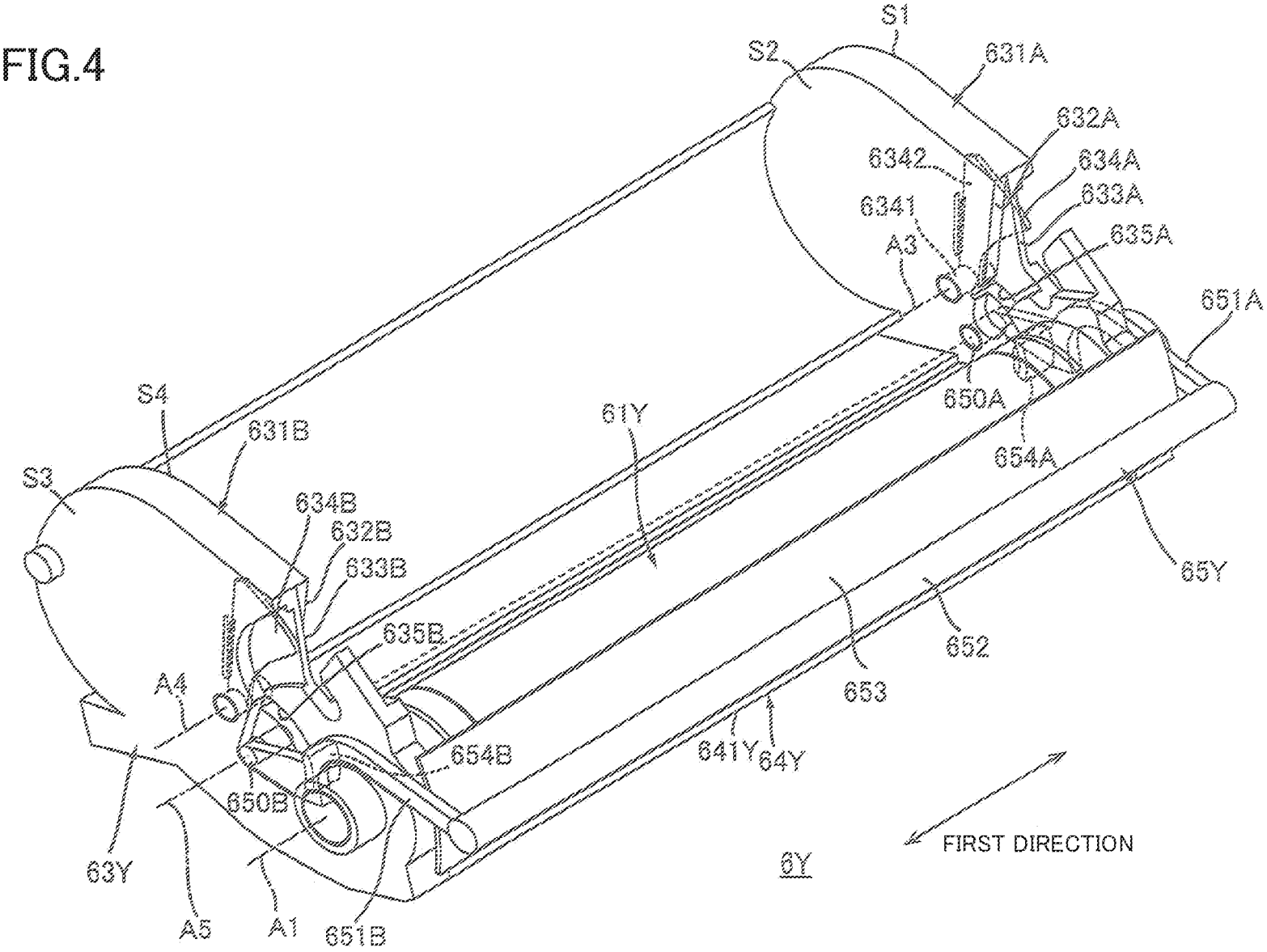
FIG. 4 is a perspective view of a drum cartridge, illustrating a state in which a moving member is located at a first position.

Next, the details of the drum cartridge 6Y will be explained with reference to FIG. 4 to FIG. 6. As illustrated in FIG. 4, the drum cartridge 6Y includes, in addition to the photoconductor drum 61Y and the charging device 62Y, a drum frame 63Y, a drum cleaner 64Y (see FIG. 5A), and a moving member 65Y.

Drum Frame 63Y

The drum frame 63Y supports the photoconductor drum 61Y and the charging device 62Y. The drum frame 63Y supports the developing cartridge 8Y in the state in which the developing cartridge 8Y is mounted on the drum cartridge 6Y. The drum frame 63Y includes two drum side plates 631A, 631B, two developing guides 632A, 632B, two developing guides 633A, 633B, and two pressing members 634A, 634B. In other words, the drum cartridge 6Y has the developing guides 632A, 632B and the pressing members 634A, 634B.

Drum Side Plates 631A, 631B

The drum side plate 631A is located at one end portion of the drum cartridge 6Y in the first direction. The drum side plate 631A extends in a direction interesting the first direction. Preferably, the drum side plate 631A extends in a direction orthogonal to the first direction. The drum side plate 631A has an outer surface S1 and an inner surface S2 in the first direction. The inner surface S2 is located between the outer surface S1 and the drum side plate 631B in the first direction. The drum side plate 631A has a through hole 635A.

The through hole 635A receives a lock member 654A of the moving member 65Y. The lock member 654A is an example of a first lock member. The lock member 654A will be explained later. The through hole 635A is located between the developing guide 633A and an axis A5 of the moving member 65Y The axis A5 will be explained later. The through hole 635A extends in a moving direction of the lock member 654A.

The drum side plate 631B is located at the other end portion of the drum cartridge 6Y in the first direction. The drum side plate 631B is spaced apart from the drum side plate 631A in the first direction. The developing cartridge 8Y is located between the first side plate 631A and the drum side plate 631B in the first direction in the state in which the developing cartridge 8Y is mounted on the drum cartridge 6Y. The drum side plate 631B extends in a direction intersecting the first direction. Preferably, the drum side plate 631B extends in a direction orthogonal to the first direction. The drum side plate 631B has an outer surface S3 and an inner surface S4 in the first direction. The inner surface S4 is located between the outer surface S3 and the drum side plate 631A in the first direction. The drum side plate 631B has a through hole 635B.

The through hole 635B receives a lock member 654B of the moving member 65Y. The lock member 654B will be explained later. The through hole 635B is located between the developing guide 633B and the axis A5 of the moving member 65Y. The through hole 635B extends in a moving direction of the lock member 654B.

Developing Guides 632A, 632B

The developing guides 632A, 632B guide the mounting of the developing cartridge 8Y with respect to the drum cartridge 6Y.

The developing guide 632A is located at the inner surface S2 of the drum side plate 631A. The developing guide 632A extends in a direction intersecting the first direction. Preferably, the developing guide 632A extends in a direction orthogonal to the first direction. A protrusion 84A (see FIG. 5A) of the developing cartridge 8Y is fitted into the developing guide 632A in the state in which the developing cartridge 8Y is mounted on the drum cartridge 6Y. The protrusion 84A will be explained later. The developing guide 632A is a groove. The developing guide 632A may also be a rib.

The developing guide 632B is located at the inner surface S4 of the drum side plate 631B. The developing guide 632B extends in a direction intersecting the first direction. Preferably, the developing guide 632B extends in a direction orthogonal to the first direction. A protrusion 84B (see FIG. 7) of the developing cartridge 8Y is fitted into the developing guide 632B in the state in which the developing cartridge 8Y is mounted on the drum cartridge 6Y. The protrusion 84B will be explained later. The developing guide 632B is a groove. The developing guide 632B may also be a rib.

Developing Guides 633A, 633B

The developing guides 633A, 633B guide the mounting of the developing cartridge 8Y with respect to the drum cartridge 6Y together with the developing guides 632A, 632B.

The developing guide 633A is provided at the drum side plate 631A. The developing guide 633A is located on an opposite side of the drum side plate 631B with respect to the developing guide 632A in the first direction. The developing guide 633A is located between the developing guide 632A and the outer surface S1 of the drum side plate 631A in the first direction.

The developing guide 633A extends in a direction intersecting the first direction. Preferably, the developing guide 633A extends in a direction orthogonal to the first direction. The developing guide 633A extends in a direction intersecting the developing guide 632A. A part of the developing guide 633A overlaps with the developing guide 632A when viewed from the first direction.

A protrusion 83A (see FIG. 7) of the developing cartridge 8Y is fitted into the developing guide 633A in the state in which the developing cartridge 8Y is mounted on the drum cartridge 6Y. The protrusion 83A will be explained later. The developing guide 633A is a groove. The developing guide 633A may also be a rib.

The developing guide 633B is provided at the drum side plate 631B. The developing guide 633B is located on an opposite side of the drum side plate 631A with respect to the developing guide 632B in the first direction. The developing guide 633B is located between the developing guide 632B and the outer surface S3 of the drum side plate 631B in the first direction.

The developing guide 633B extends in a direction intersecting the first direction. Preferably, the developing guide 633B extends in a direction orthogonal to the first direction. The developing guide 633B extends in a direction intersecting the developing guide 632B. A part of the developing guide 633B overlaps with the developing guide 632B when viewed from the first direction.

A protrusion 83B (see FIG. 7) of the developing cartridge 8Y is fitted into the developing guide 633B in the state in which the developing cartridge 8Y is mounted on the drum cartridge 6Y. The protrusion 83B will be explained later. The developing guide 633B is a groove. The developing guide 633B may also be a rib.

Pressing Members 634A, 634B

The pressing member 634A is located inside the drum side plate 631A. The pressing member 634A is located between the developing guide 633A and the outer surface S1 in the first direction. The pressing member 634A is movable between a pressing position (see FIG. 5B) and a press-release position (see FIG. 5A). The pressing member 634A is pivotable about an axis A3 between the pressing position and the press-releasing position. The axis A3 extends in the first direction.

Figure 5A:
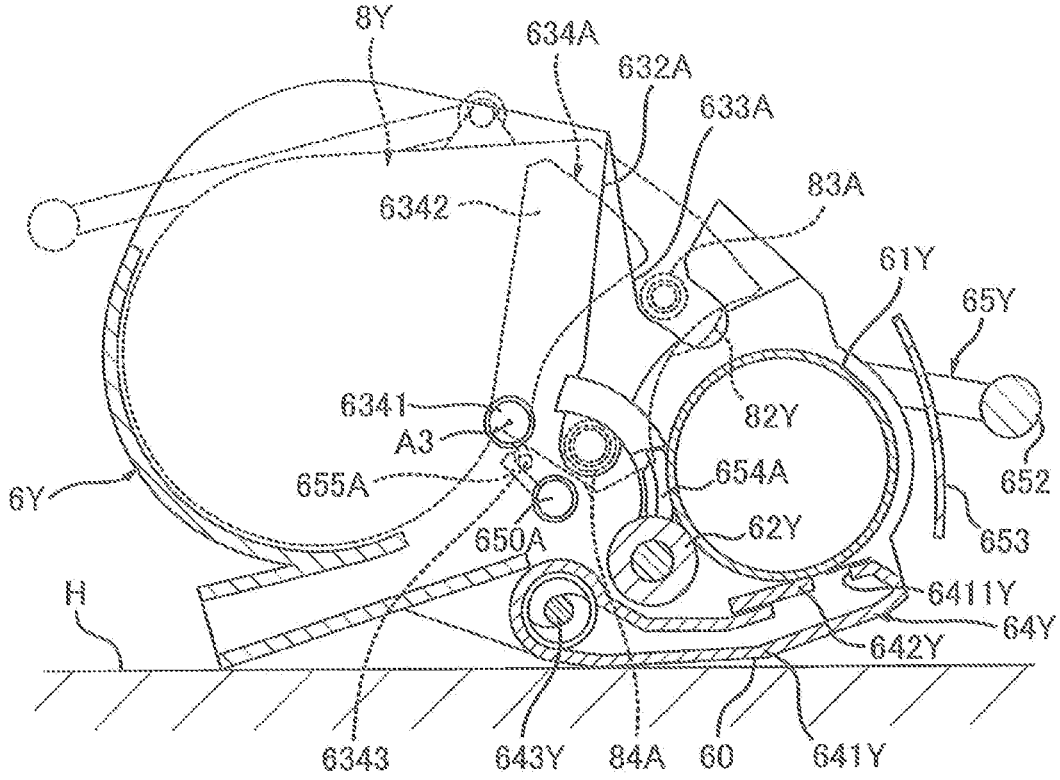
FIG. 5A is a cross-sectional view of the drum cartridge illustrated in FIG. 4, illustrating a state in which the moving member is located at the first position, a lock member is located at a lock-release position, and a pressing member is located at a press-releasing position.
Figure 5B:
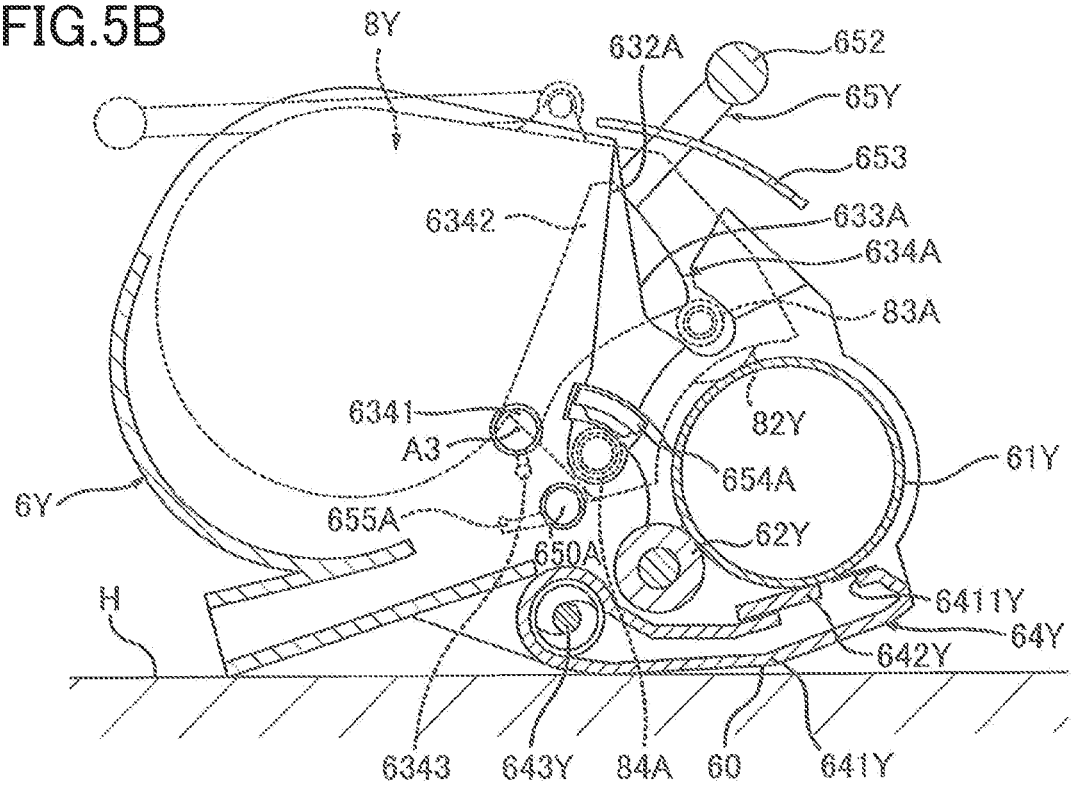
FIG. 5B is a cross-sectional view of the drum cartridge illustrated in FIG. 5A, illustrating a state in which the moving member is located at a second position, the lock member is located at a lock position, and the pressing member is located at a press position.

As illustrated in FIG. 5B, the pressing member 634A presses the protrusion 83A of the developing cartridge 8Y toward the photoconductor drum 61Y in a state in which the developing cartridge 8Y is mounted on the drum cartridge 6Y and the pressing member 634A is located at the pressing position.

On the other hand, the pressing member 634A is spaced apart from the protrusion 83A of the developing cartridge 8Y in a stated where the developing cartridge 8Y is mounted on the drum cartridge 6Y and the pressing member 634A is located at the press-release position as illustrated in FIG. 5A. Accordingly, the pressing member 634A releases pressing of the developing cartridge 8Y with respect to the protrusion 83A.

The pressing member 634A includes a shaft 6341, a body portion 6342, and a protrusion 6343.

The shaft 6341 extends in the first direction along the axis A3.

The body portion 6342 extends from the shaft 6341. The body portion 6342 extends in a direction intersecting the first direction. Preferably, the body portion 6342 extends in a direction orthogonal to the first direction. The body portion 6342 has a flat-plate shape. As illustrated in FIG. 5B, the body portion 6342 contacts the protrusion 83A of the developing cartridge 8Y in the state in which the pressing member 634A is located at the press position.

The protrusion 6343 extends from the shaft 6341. The protrusion 6343 extends in a direction intersecting the first direction. Preferably, the protrusion 6343 extends in a direction orthogonal to the first direction. As illustrated in FIG. 5A, the protrusion 6343 contacts a press-releasing member 655A of the moving member 65Y in a state in which the moving member 65Y is located at a first position and the pressing member 634A is located at the press-releasing position. The first position of the moving member 65Y and the press-releasing member 655A will be explained later.

As illustrated in FIG. 4, the pressing member 634B is located inside the drum side plate 631B. The pressing member 634B is located between the developing guide 633B and the outer surface S3 in the first direction. The pressing member 634B is movable between a second pressing position (see FIG. 6) and a second press-release position (see FIG. 4). The pressing member 634B is pivotable about an axis A4 between the second pressing position and the second press-releasing position. The axis A4 extends in the first direction.

The pressing member 634B presses the protrusion 83B (see FIG. 7) of the developing cartridge 8Y toward the photoconductor drum 61Y in a state in which the developing cartridge 8Y is mounted on the drum cartridge 6Y and the pressing member 634B is located at the press position.

On the other hand, the pressing member 634B releases the pressing of the developing cartridge 8Y with respect to the protrusion 83B in a state in which the developing cartridge 8Y is mounted on the drum cartridge 6Y and the pressing member 634B is located at the press-releasing position.

Explanation for the pressing member 634B is the same as the explanation for the pressing member 634A. Therefore, the explanation for the pressing member 634B is omitted.

When the pressing member 634A presses the protrusion 83A and the pressing member 634B presses the protrusion 83B in the state in which the developing cartridge 8Y is mounted on the drum cartridge 6Y, the developing roller 82Y (see FIG. 1) is pressed onto the photoconductor drum 61Y.

Drum Cleaner 64Y

As illustrated in FIG. 5A, the drum cleaner 64Y cleans the circumferential surface of the photoconductor drum 61Y. The drum cleaner 64Y includes a cleaning housing 641Y, a cleaning member 642Y, and a screw 643Y.

As illustrated in FIG. 4, the cleaning housing 641Y is located between the drum side plate 631A and the drum side plate 631B in the first direction. The cleaning housing 641Y extends in the first direction. One end portion of the cleansing housing 641Y in the first direction is connected to the drum side plate 631A. The other end portion of the cleaning housing 641Y in the first direction is connected to the drum side plate 631B. The cleaning housing 641Y is capable of containing waste toner.

As illustrated in FIG. 5A, the cleaning housing 641Y includes an opening 6411Y. The cleaning housing 641Y is located below the photoconductor drum 61Y in a state in which the drum cartridge 6Y is put on a horizontal surface H. The cleaning housing 641Y is opposed to the horizontal surface H in the state in which drum cartridge 6Y is put on the horizontal surface H. The cleaning housing 641Y has a bottom surface 60 of the drum cartridge 6Y. The bottom surface 60 of the drum cartridge 6Y is opposed to the horizontal surface H in the state in which drum cartridge 6Y is put on the horizontal surface H. The charging device 62Y is located between the cleaning housing 641Y and the photoconductor drum 61Y.

The cleaning member 642Y cleans the circumferential surface of the photoconductor drum 61Y. The cleaning member 642Y is mounted to the cleaning housing 641Y. An edge of the cleaning member 642 contacts the circumferential surface of the photoconductor drum 61Y. Waste toner cleaned from the circumferential surface of the photoconductor drum 61Y by the cleaning member 642Y enters the cleaning housing 641Y through the opening 6411Y The screw 643Y is located inside the cleaning housing 641. The screw 643Y conveys the waste toner inside the cleaning housing 641Y in the first direction. The screw 643Y is an auger screw in the embodiment. The screw 643Y extends in the first direction. The screw 643Y may be a shaftless screw.

Moving Member 65Y

Figure 6:
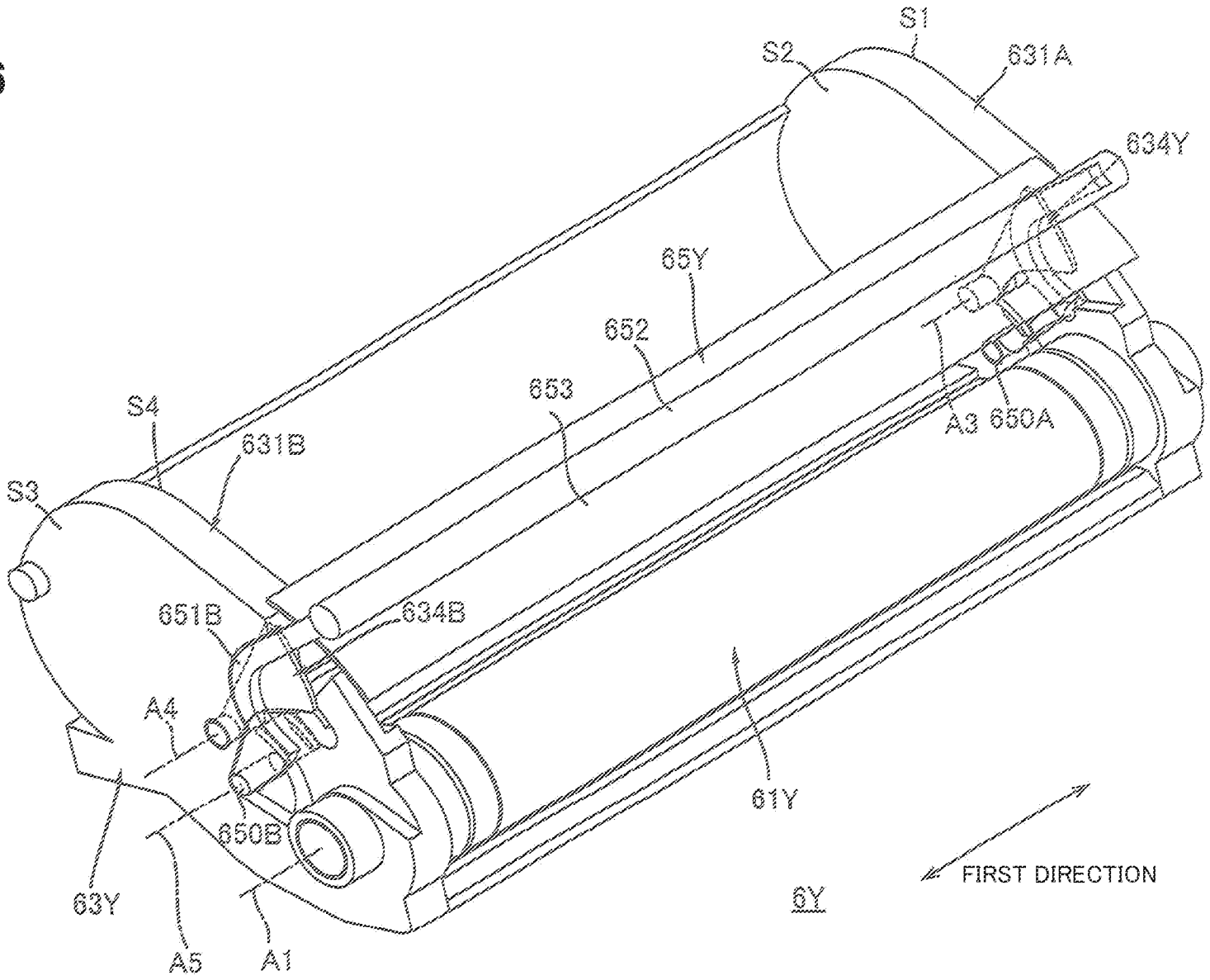
FIG. 6 is a perspective view of the drum cartridge illustrated in FIG. 4, illustrating a state in which a drum cover is located at the second position.

As illustrated in FIG. 4 and FIG. 6, the moving member 65Y is movable with respect to the photoconductor drum 61Y between the first position (see FIG. 4) and a second position (see FIG. 6). The moving member 65Y is rotatable about the axis A5 between the first position and the second position. The axis A5 extends in the first direction.

As illustrated in FIG. 4, the moving member 65Y is opposed to the circumferential surface of the photoconductor drum 61Y in a state in which the moving member 65Y is located at the first position. Accordingly, it is possible to protect the circumferential surface of the photoconductor drum 61Y in the state in which the moving member 65Y is located at the first position.

As illustrated in FIG. 5A, the moving member 65Y is not opposed to the developing cartridge 8Y which is mounted on the drum cartridge 6Y in the state in which the moving member 65Y is located at the first position. Accordingly, the developing cartridge 8Y is removable from the drum cartridge 6Y in the state in which the developing cartridge 8Y is mounted on the drum cartridge 6Y and the moving member 65Y is located at the first position.

The moving member 65Y is located between the drum cleaner 64Y and the developing cartridge 8Y in the state in which the developing cartridge 8Y is mounted on the drum cartridge 6Y and the moving member 65Y is located at the first position. The moving member 65Y is located between the drum cleaner 64Y and the developing roller 82Y in the state in which the developing cartridge 8Y is mounted on the drum cartridge 6Y and the moving member 65Y is located at the first position. Accordingly, the circumferential surface of the photoconductor drum 61Y is protected by being covered with the developing cartridge 8Y mounted on the drum cartridge 6Y and the moving member 65Y located at the first position.

As illustrated in FIG. 6, the moving member 65Y is not opposed to the circumferential surface of the photoconductor drum 61Y in a state in which the moving member 65Y is located at the second position.

Accordingly, when the drawer 5 is located at the accommodated position in the state in which drum cartridge 6Y is mounted on the drawer 5 and the moving member 65Y is located at the second position, the circumferential surface of the photoconductor drum 61Y is allowed to contact the belt 91.

As illustrated in FIG. 5B, the moving member 65Y is opposed to the developing cartridge 8Y mounted on the drum cartridge 6Y in the state in which the moving member 65Y is located at the second position. Specifically, the moving member 65 is opposed to the developing cartridge 8Y in a direction in which the developing guide 632A extends in the state in which the developing cartridge 8Y is mounted on the drum cartridge 6Y and the moving member 65Y is located at the second position. Accordingly, it is incapable of removing the developing cartridge 8Y from the drum cartridge 6Y in the state in which the developing cartridge 8Y is mounted on the drum cartridge 6Y and the moving member 65Y is located at the second position.

The moving member 65Y is located on an opposite side of the drum cleaner 64Y with respect to the photoconductor drum 61Y in the state in which the moving member 65Y is located at the second position.

As illustrated in FIG. 3, the moving member 65Y is movable between the first position and the second position in a state in which the developing cartridge 8Y is mounted on the drum cartridge 6Y, the drum cartridge 6Y is mounted on the drawer 5, and the drawer 5 is located at the drawn position. Preferably, the moving member 65Y is located at the first position in the state in which the developing cartridge 8Y is mounted on the drum cartridge 6Y, the drum cartridge 6Y is mounted on the drawer 5, and the drawer 5 is located at the drawn position.

As illustrated in FIG. 1, the moving member 65Y is located at the second position in a state in which developing cartridge 8Y is mounted on the drum cartridge 6Y, the drum cartridge 6Y is mounted on the drawer 5, and the drawer 5 is located at the accommodated position.

As illustrated in FIG. 4, the moving member 65Y includes two shafts 650A, 650B, two arms 651A, 651B, a handle 652, a drum cover 653, two lock members 654A, 654B, two press-releasing members 655A (see FIG. 5A), 655B. The handle is an example of a first handle. In other words, the drum cartridge 6Y includes the press-releasing members 655A, 655B. It is noted that the press-releasing member 655B is not illustrated.

Shafts 650A, 650B

The shaft 650A is supported by the drum side plate 631A. The shaft 650A extends in the first direction along the axis A5.

The shaft 650B is supported by the drum side plate 631B. The shaft 650B is spaced apart from the shaft 650A in the first direction. The shaft 650B extends in the first direction along the axis A5.

Arms 651A, 651B

The arm 651A is located at the outer surface S1 of the drum side plate 631A. The arm 651A is located at one end portion of the moving member 65Y in the first direction. The arm 651A is rotatable about the axis A5. The arm 651A extends from the shaft 650A. The arm 651A extends in a direction intersecting the first direction. Preferably, the arm 651A extends in a direction orthogonal to the first direction.

The arm 651B is located at the outer surface S3 of the drum side plate 631B. The arm 651B is located at the other end portion of the drum cover 653 in the first direction. The arm 651A is spaced apart from the arm 651B in the first direction. The arm 651B is rotatable about the axis A5. The arm 651B extends from the shaft 650B. The arm 651B extends in a direction intersecting the first direction. Preferably, the arm 651B extends in a direction orthogonal to the first direction.

Handle 652

The handle 652 extends in the first direction. One end portion of the handle 652 in the first direction is connected to the arm 651A. The other end portion of the handle 652 in the first direction is connected to the arm 651B.

As illustrated in FIG. 3, a user can grasp the handle 652 and pull out the drum cartridge 6Y from the drawer 5 in the state in which the drum cartridge 6Y is mounted on the drawer 5 and the drawer 5 is located at the drawn position.

Drum Cover 653

As illustrated in FIG. 4, the drum cover 653 is located between the arm 651A and the arm 651B in the first direction. The drum cover 653 extends in the first direction. The drum cover 653 covers a part of the circumferential surface of the photoconductor drum 61Y in the state in which the moving member 65Y is located at the first position. The drum cover 653 extends along the circumferential surface of the photoconductor drum 61Y in the state in which the moving member 65Y is located at the first position.

Lock Members 654A, 654B

As illustrated in FIG. 4, the lock member 654A extends from the arm 651A. The lock member 654A may be mounted to the arm 651A. The lock member 654A extends in the first direction. The lock member 654A is located inside the through hole 635A.

As illustrated in FIG. 5A and FIG. 5B, the lock member 654A is located between a lock position (see FIG. 5B) and a lock-release position (see FIG. 5A).

As illustrated in FIG. 5B, the lock member 654A is located at the lock position in the state in which the developing cartridge 8Y is mounted on the drum cartridge 6Y and the moving member 65Y is located at the second position. The lock member 654A locks the developing cartridge 8Y to the drum cartridge 6Y in the state in which the lock member 654A is located at the lock position.

To lock the developing cartridge 8Y to the drum cartridge 6Y is to prevent the developing cartridge 8Y from being removed from the drum cartridge 6Y. The lock member 654A is located inside the developing guide 632A in the state in which the lock member 654A is located at the lock position. The lock member 654A is opposed to the protrusion 84A of the developing cartridge 8Y in a direction in which the developing guide 632A extends in the state in which the developing cartridge 8Y is mounted on the drum cartridge 6Y and the lock member 654A is located at the lock position. Accordingly, when the developing cartridge 8Y moves in the direction in which the developing guide 632A extends in the state in which the developing cartridge 8Y is mounted on the drum cartridge 6Y and the lock member 654A is located at the lock position, the protrusion 84A of the developing cartridge 8Y comes into contact with the lock member 654A. Accordingly, it is possible to prevent the developing cartridge 8Y from being removed from the drum cartridge 6Y.

On the other hand, the lock member 654A is located at the lock-release position in the state in which the developing cartridge 8Y is mounted on the drum cartridge 6Y and the moving member 65Y is located at the first position as illustrated in FIG. 5A. The lock member releases the locking of the developing cartridge with respect to the drum cartridge in the state in which the lock member is located at the lock-release position. The lock member 654A is removed from the developing guide 632A in the state in which the lock member 654A is located at the lock-release position. Accordingly, the developing cartridge 8Y becomes removable from the drum cartridge 6Y.

As illustrated in FIG. 4, the lock member 654B extends from the arm 651B. The lock member 654B is spaced apart from the lock member 654A in the first direction. The lock member 654B may be mounted to the arm 651B. The lock member 654B extends in the first direction. The lock member 654B is located inside the through hole 635B.

Explanation for the lock member 654B is the same as the explanation for the lock member 654A. That is, the lock member 654B is located at a second lock position (see FIG. 6) in the state in which the developing cartridge 8Y is mounted on the drum cartridge 6Y and the moving member 65Y is located at the second position. The lock member 654B locks the developing cartridge 8Y to the drum cartridge 6Y in a state in which the lock member 654B is located at the second lock position. On the other hand, the lock member 654B is located at a second lock-release position (see FIG. 4) in the state in which the developing cartridge 8Y is mounted on the drum cartridge 6Y and the moving member 65Y is located at the first position. The lock member 654B releases the locking of the developing cartridge 8Y with respect to the drum cartridge 6Y in a state in which the lock member 654B is located at the second lock-release position.

Press-Releasing Members 655A, 655B

As illustrated in FIG. 5A, the press-releasing member 655A is located inside the drum side plate 631A. The press-releasing member 655A extends from the shaft 650A of the moving member 65Y. The press-releasing member 655A extends in a direction intersecting the first direction. Preferably, the press-releasing member 655A extends in a direction orthogonal to the first direction.

The press-releasing member 655A causes the pressing member 634A to be located at the press-release position in the state in which the moving member 65Y is located at the first position. Specifically, the press-releasing member 655A presses the protrusion 6343 of the pressing member 634A in a direction in which the pressing member 634A pivots from the press position to the press-release position in conjunction with the movement of the moving member 65Y from the second position (see FIG. 5B) to the first position (see FIG. 5A). Then, the pressing member 634A pivots from the press position to the press-releasing position.

On the other hand, as illustrated in FIG. 5B, the press-releasing member 655A allows the pressing member 634A to be located at the press position in the state in which the moving member 65Y is located at the second position. Specifically, the press-releasing member 655A is moved from the protrusion 6343 of the pressing member 634A in conjunction with the movement of the moving member 65Y from the first position (see FIG. 5A) to the second position (see FIG. 5B). Then, the pressing member 634A pivots from the press-release position to the press position.

Explanation for the not-illustrated press-releasing member 655B is the same as the explanation for the press-releasing member 655A. The press-releasing member 655B is located inside the drum side plate 631B (see FIG. 4). The press-releasing member 655B extends from the shaft 650B (see FIG. 4) of the moving member 65Y. The press-releasing member 655B extends in a direction intersecting the first direction. Preferably, the press-releasing member 655B extends in a direction orthogonal to the first direction. The press-releasing member 655B causes the pressing member 634B (see FIG. 4) to be located at the press-release position in the state in which the moving member 65Y is located at the first position. On the other hand, the press-releasing member 655B allows the pressing member 634B to be located at the press position in the state in which the moving member 65Y is located at the second position.

Details of Developing Cartridge 8Y

Figure 7:
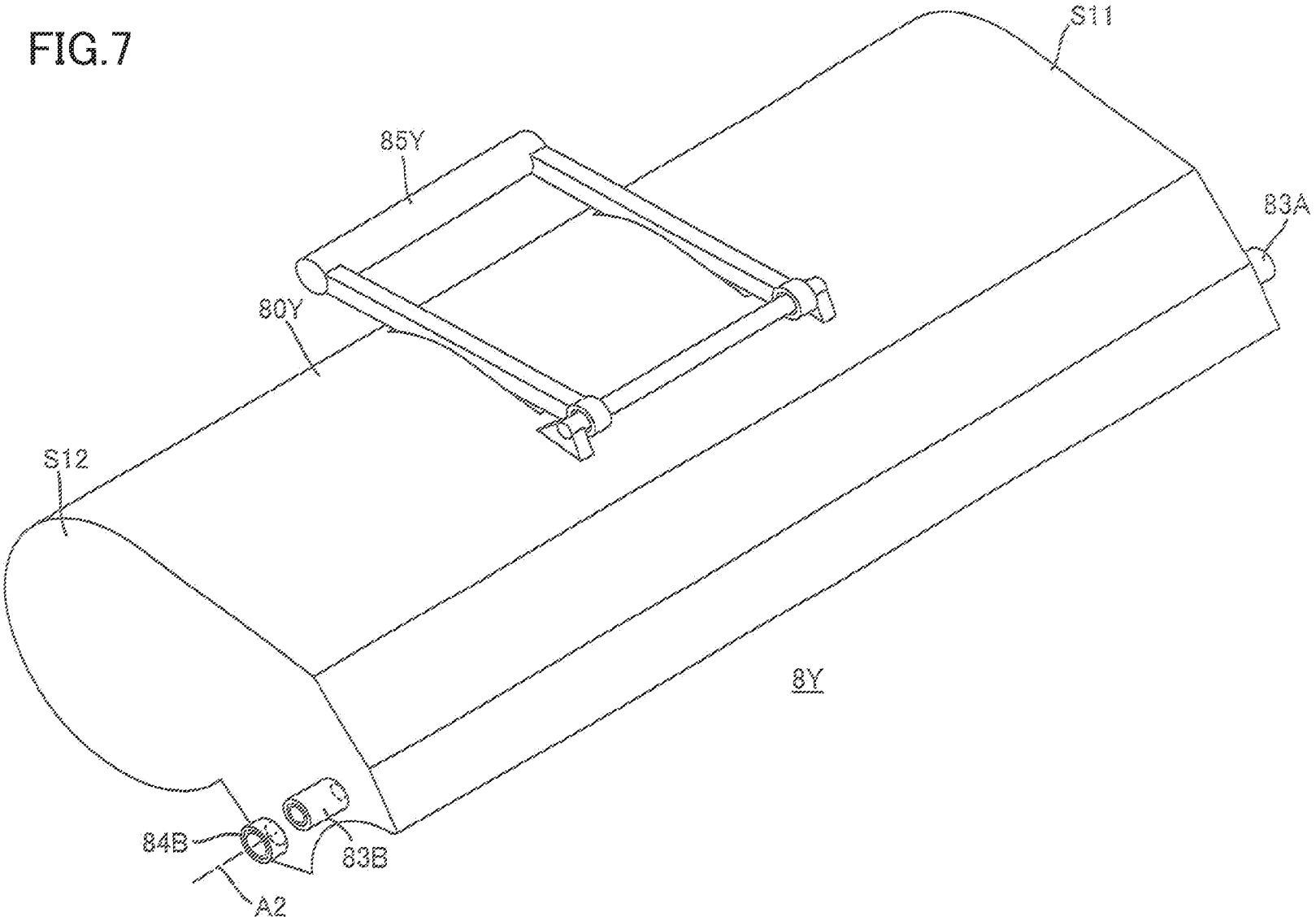
FIG. 7 is a perspective view of a developing cartridge.

Next, the details of the developing cartridge 8Y will be explained with reference to FIG. 7.

The developing cartridge 8Y includes, in addition to the above developing roller 82Y, a developing housing 80Y, two protrusions 83A, 83B, two protrusions 84A (see FIG. 5A), 84B, a second handle 85Y.

Developing Housing 80Y

The developing housing 80Y includes the toner container 81Y. The developing housing 80Y extends in a direction in which the developing axis A2 extends. The developing housing 80Y has one outer surface S11 and the other outer surface S12 in the direction in which the developing axis A2 extends.

Protrusions 83A, 83B

The protrusion 83A is located at the outer surface S11 of the developing housing 80Y. The protrusion 83A extends in the first direction. The protrusion 83A extends along the developing axis A2. The protrusion 83A extends from the outer surface S11 of the developing housing 80Y. The protrusion 83A may be mounted to the outer surface S11 of the developing housing 80Y. The protrusion 83A may be a shaft of the developing roller 82Y. The protrusion 83A is fitted into the developing guide 633A (see FIG. 4) in the state in which the developing cartridge 8Y is mounted on the drum cartridge 6Y.

The protrusion 83B is located at the outer surface S12 of the developing housing 80Y. The protrusion 83B extends in the first direction. The protrusion 83B extends along the developing axis A2. The protrusion 83B extends from the outer surface S12 of the developing housing 80Y. The protrusion 83B may be mounted to the outer surface S12 of the developing housing 80Y. The protrusion 83B may be the shaft of the developing roller 82Y. The protrusion 83B is fitted into the developing guide 633B (see FIG. 4) in the state in which the developing cartridge 8Y is mounted on the drum cartridge 6Y.

Protrusions 84A, 84B

The protrusion 84A (see FIG. 5A) is located at the outer surface S11 of the developing housing 80Y. The protrusion 84A is spaced apart from the protrusion 83A. The protrusion 84A extends in the first direction. The protrusion 84A extends from the outer surface S11 of the developing housing 80Y. The protrusion 84A may be mounted to the outer surface S11 of the developing housing 80Y. The protrusion 84A is fitted into the developing guide 632A (see FIG. 5A) in the state in which the developing cartridge 8Y is mounted on the drum cartridge 6Y.

The protrusion 84B is located at the outer surface S12 of the developing housing 80Y. The protrusion 84B is spaced apart from the protrusion 83B. The protrusion 84B extends in the first direction. The protrusion 84B extends from the outer surface S12 of the developing housing 80Y. The protrusion 84B may be mounted to the outer surface S12 of the developing housing 80Y. The protrusion 84B is fitted into the developing guide 632B (see FIG. 4) in the state in which the developing cartridge 8Y is mounted on the drum cartridge 6Y.

Second Handle 85Y

The second handle 85Y is located at a center portion of the developing housing 80Y in the direction in which the developing axis A2 extends. The second handle 85Y is located between the outer surface S11 and the outer surface S12 in the direction in which the developing axis A2 extends. The second handle 85Y is mounted to the developing housing 80Y. The second handle 85Y is pivotable with respect to the developing housing 80Y. The user can carry the developing cartridge 8Y by grasping the second handle 85Y.

As illustrated in FIG. 1, the second handle 85Y is located at a position below the handle 652 in the state in which the developing cartridge 8Y is mounted on the drum cartridge 6Y and the drum cartridge 6Y is mounted on the drawer 5. Accordingly, the user can grasp the handle 652 without hesitation about which of the handle 652 and the second handle 85Y should be grasped in the state in which the developing cartridge 8Y is mounted on the drum cartridge 6Y, the drum cartridge 6Y is mounted on the drawer 5, and the drawer 5 is located at the drawn position.

Operation and Effect

According to the image forming apparatus 1, by locating the moving member 65Y at the first position in the state in which the drum cartridge 6Y is mounted on the drawer 5 and the drawer 5 is located at the drawn position as illustrated in FIG. 3, thereby it is possible to protect the circumferential surface of the photoconductor drum 61Y by the moving member 65Y.

Moreover, according to the image forming apparatus 1, as illustrated in FIG. 5B, the moving member 65Y is opposed to the developing cartridge 8Y mounted on the drum cartridge 6Y in the state in which the moving member 65Y is located at the second position.

Accordingly, it is possible to suppress the removal of the developing cartridge 8Y from the drum cartridge 6Y in a state in which the moving member 65Y is not located at the first position.

As a result, when the developing cartridge 8Y is removed from the drum cartridge 6Y, it is possible to certainly locate the moving member 65Y at the first position and to thereby protect the circumferential surface of the photoconductor drum 61Y.

According to the image forming apparatus 1, as illustrated in FIG. 5B, the moving member 65Y is opposed to the developing cartridge 8Y in the direction in which the developing guide 632A extends in the state in which the developing cartridge 8Y is mounted on the drum cartridge 6Y and the moving member 65Y is located at the second position.

Accordingly, it is possible to further suppress the removal of the developing cartridge 8Y from the drum cartridge 6Y in the state in which the moving member 65Y is not located at the first position.

According to the image forming apparatus 1, the moving member 65Y is preferably located at the first position in the state in which the developing cartridge 8Y is mounted on the drum cartridge 6Y, the drum cartridge 6Y is mounted on the drawer 5, and the drawer 5 is located at the drawn position as illustrated in FIG. 3.

Accordingly, it is possible to protect the circumferential surface of the photoconductor drum 61Y in the state in which the developing cartridge 8Y is mounted on the drum cartridge 6Y, the drum cartridge 6Y is mounted on the drawer 5, and the drawer 5 is located at the drawn position.

On the other hand, as illustrated in FIG. 1, the moving member 65Y is located at the second position in the state in which the developing cartridge 8Y is mounted on the drum cartridge 6Y, the drum cartridge 6Y is mounted on the drawer 5, and the drawer 5 is located at the accommodated position.

Accordingly, the circumferential surface of the photoconductor drum 61Y is allowed to contact the belt 91 in the state in which developing cartridge 8Y is mounted on the drum cartridge 6Y, the drum cartridge 6Y is mounted on the drawer 5, and the drawer 5 is located at the accommodated position.

According to the image forming apparatus 1, as illustrated in FIG. 4, the moving member 65Y includes the drum cover 653. The drum cover 653 covers the circumferential surface of the photoconductor drum 61Y in the state in which the moving member 65Y is located at the first position.

Accordingly, it is possible to protect the circumferential surface of the photoconductor drum 61Y more certainly.

According to the image forming apparatus 1, as illustrated in FIG. 3, the second handle 85Y is located at the position below the handle 652 in the state in which the developing cartridge 8Y is mounted on the drum cartridge 6Y and the drum cartridge 6Y is mounted on the drawer 5.

Accordingly, the user can grasp the handle 652 without hesitation about which of the handle 652 and the second handle 85Y should be grasped in the state in which the developing cartridge 8Y is mounted on the drum cartridge 6Y, the drum cartridge 6Y is mounted on the drawer 5, and the drawer 5 is located at the drawn position.

According to the image forming apparatus 1, as illustrated in FIG. 4, the moving member 65Y includes the lock member 654A. as illustrated in FIG. 5B, the lock member 654A locks the developing cartridge 8Y to the drum cartridge 6Y in the state in which the developing cartridge 8Y is mounted on the drum cartridge 6Y and the moving member 65Y is located at the second position.

Accordingly, it is possible to further suppress the removal of the developing cartridge 8Y from the drum cartridge 6Y in the state in which the moving member 65Y is not located at the first position by the lock member 654A.

According to the image forming apparatus 1, as illustrated in FIG. 4, the moving member 65Y further includes the lock member 654B. The lock member 654B locks the developing cartridge 8Y to the drum cartridge 6Y in the state in which the developing cartridge 8Y is mounted on the drum cartridge 6Y and the moving member 65Y is located at the second position.

Accordingly, it is possible to further suppress the removal of the developing cartridge 8Y from the drum cartridge 6Y by the lock member 654A and the lock member 654B in the state in which the moving member 65Y is not located at the first position.

According to the image forming apparatus 1, as illustrated in FIG. 5A, the drum cartridge 6Y includes the press-releasing member 655A. The press-releasing member 655A causes the pressing member 634A to be located at the press-release position in the state in which the moving member 65Y is located at the first position.

Accordingly, by locating the moving member 65Y at the first position, thereby it is possible to release the pressing of the developing cartridge 8Y with respect to the photoconductor drum 61Y.

As a result, it is possible to remove the developing cartridge 8Y from the drum cartridge 6Y easily in the state in which the moving member 65Y is allowed to be located at the first position.

Modification

Modifications will be explained with reference to FIG. 8 and FIG. 9. In the modification, the same symbols are attached to the same components as those of the above embodiment, and explanation thereof is omitted.

Figure 8:
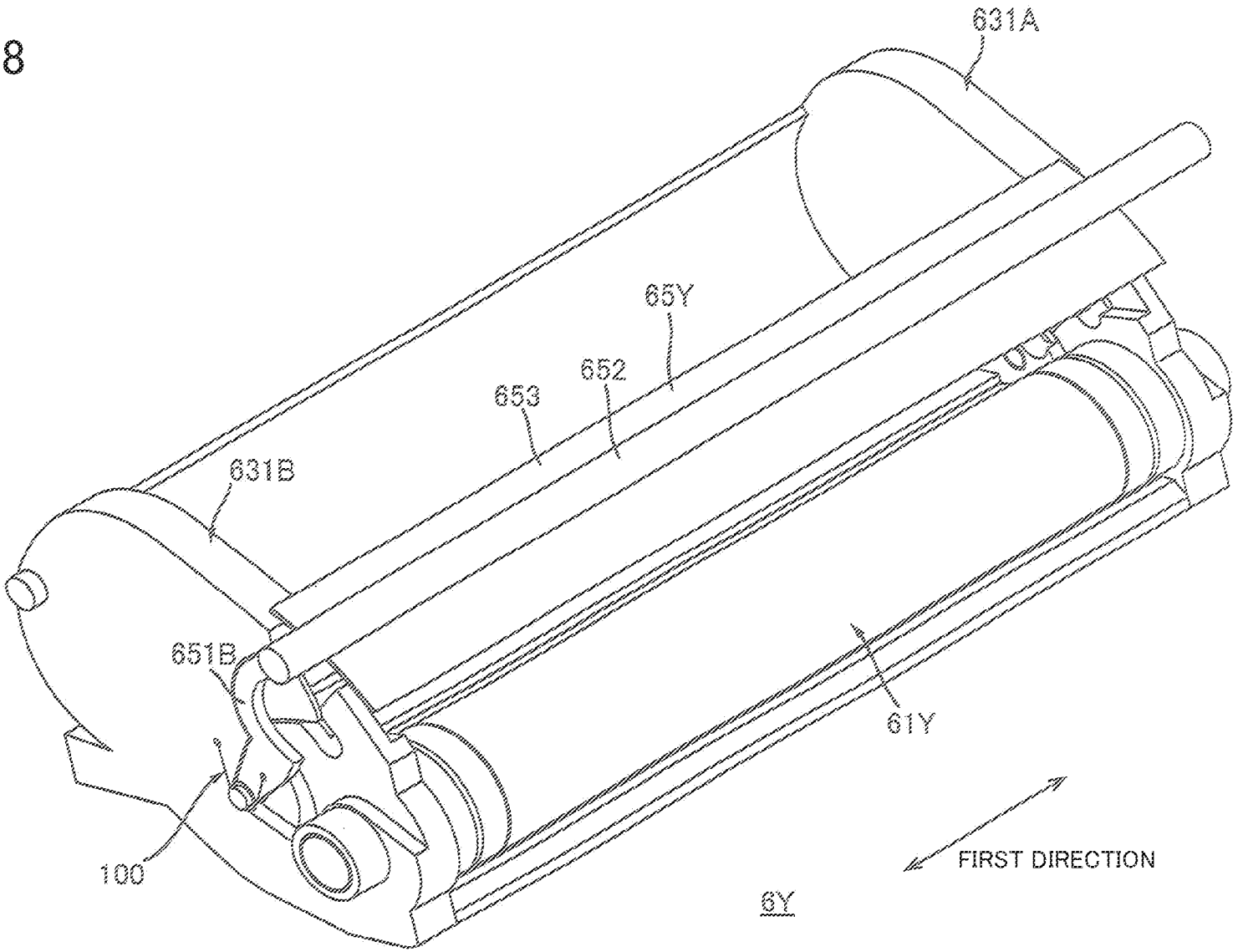
FIG. 8 is an explanatory view for explaining a first modification.

As illustrated in FIG. 8, the drum cartridge 6Y may include a spring 100. The spring 100 presses, toward the first position, the moving member 65Y located at the second position. The spring 100 is, for example, a torsion spring. One end of the spring 100 is fixed to the drum side plate 631B. The other end of the spring 100 is fixed to the arm 651B of the moving member 65Y.

According to the modification, it is possible to move the moving member 65Y from the second position to the first position by the force of the spring 100 without executing the operation of moving the moving member 65Y from the second position to the first position.

As a result, it is possible to smoothly perform replacement work of the developing cartridge 8Y or the drum cartridge 6Y.

Figure 9:
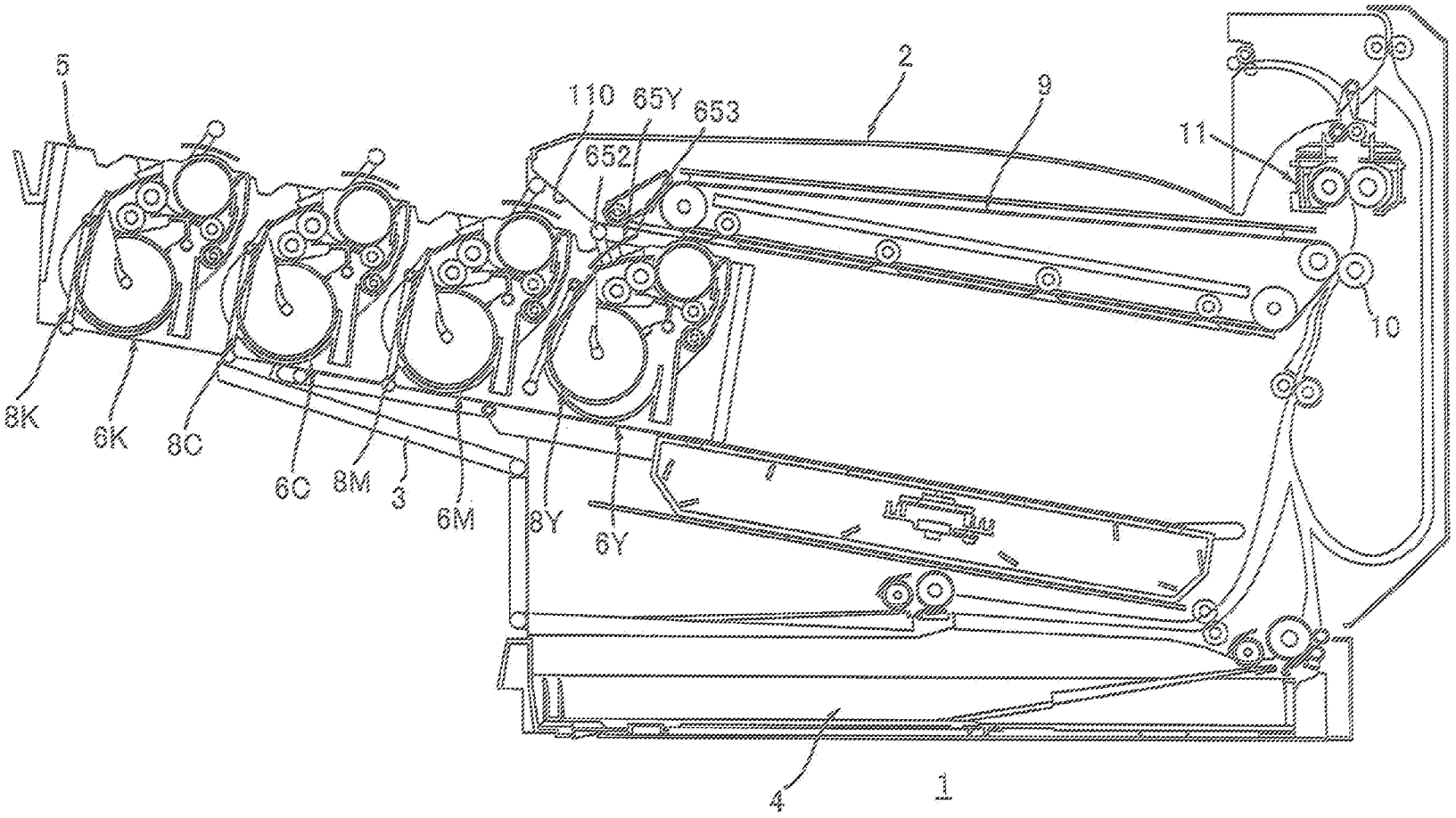
FIG. 9 is an explanatory view for explaining a second modification.

As illustrated in FIG. 9, the moving member 65Y may move from the first position to the second position in conjunction with the movement of the drawer 5 from the drawn position to the accommodated position. Specifically, the moving member 65Y may move from the first position to the second position by contacting an inclined surface 110 of the body housing 2 when the drawer 5 moves from the drawn position to the accommodated position. The inclined surface 110 is located between the belt unit 9 and the cover 3 in the moving direction of the drawer 5.

According to the modification, it is possible to move the moving member 65Y from the first position to the second position by the operation of moving the drawer 5 from the drawn position to the accommodated position with a simple structure without performing the work of moving the moving member 65Y from the first position to the second position.

As a result, it is possible to smoothly perform replacement work of the developing cartridge 8Y or the drum cartridge 6Y.

What is claimed is:

1. A process cartridge, comprising:

a drum cartridge comprising a photoconductor drum; and a developing cartridge comprising a developing roller, the developing cartridge being mountable on the drum cartridge;

wherein the drum cartridge further comprises:

a drum frame supporting the photoconductor drum, the drum frame having a guide that guides mounting of the developing cartridge with respect to the drum cartridge, and a moving member movable, with respect to the photoconductor drum, between (i) a first position at which the moving member is opposing to a circumferential surface of the photoconductor drum and not opposing to the guide on the drum frame, and (ii) a second position at which the moving member is not opposing to the circumferential surface of the photoconductor drum and is opposing to the guide on the drum frame.

2. The process cartridge according to claim 1, wherein the moving member is opposing to the developing cartridge in a direction in which the guide extends in a state in which the developing cartridge is mounted on the drum cartridge and the moving member is located at the second position.

3. The process cartridge according to claim 1, wherein the drum cartridge includes a spring that presses the moving member located at the second position toward the first position.

4. The process cartridge according to claim 1, wherein the drum cartridge further includes a drum cleaner that cleans the photoconductor drum, and wherein the moving member is located on an opposite side of the drum cleaner with respect to the photoconductor drum in a state in which the moving member is located at the second position.

5. The process cartridge according to claim 4, wherein the moving member is located between the drum cleaner and the developing roller in a state in which the developing cartridge is mounted on the drum cartridge and the moving member is located at the first position.

6. The process cartridge according to claim 1, wherein the moving member includes a drum cover that covers the circumferential surface of the photoconductor drum in a state in which the moving member is located at the first position.

7. The process cartridge according to claim 1, wherein the moving member includes a first handle.

8. The process cartridge according to claim 1, wherein the drum frame of the drum cartridge further includes a drum side plate that rotatably supports the photoconductor drum, and the photoconductor drum is rotatable about a drum axis extending in a first direction.

9. The process cartridge according to claim 8, wherein the moving member includes an arm disposed at an outer surface of the drum side plate, and wherein the arm is rotatable about an axis extending in the first direction.

10. The process cartridge according to claim 9, wherein the arm supports the drum cover that is opposing to the circumferential surface of the photoconductor drum in a state in which the moving member is located at the first position.

11. The process cartridge according to claim 1, wherein the moving member further includes a first lock member, wherein the first lock member is located at a lock position at which the first lock member locks the developing cartridge to the drum cartridge in the state in which the developing cartridge is mounted on the drum cartridge and the moving member is located at the second position, and wherein the first lock member is located at a lock-release position at which the first lock member releases the lock of the developing cartridge with respect to the drum cartridge in the state in which the developing cartridge is mounted on the drum cartridge and the moving member is located at the first position.

12. The process cartridge according to claim 11, wherein the photoconductor drum is rotatable about the drum axis extending in a first direction, wherein the moving member further includes a second lock member spaced apart from the first lock member in the first direction, wherein the second lock member is located at a second lock position at which the second lock member locks the developing cartridge to the drum cartridge in the state in which the developing cartridge is mounted on the drum cartridge and the moving member is located at the second position, and wherein the second lock member is located at a second lock-release position at which the second lock member releases the lock of the developing cartridge with respect to the drum cartridge in the state in which the developing cartridge is mounted on the drum cartridge and the moving member is located at the first position.

13. The process cartridge according to claim 1, wherein the drum cartridge further includes:

a pressing member movable between a press position at which the pressing member presses the developing cartridge toward the photoconductor drum and a press-release position at which the pressing member releases the pressing with respect to the developing cartridge; and a press-releasing member allowing the pressing member to be located at the press-release position in the state in which the moving member is located at the first position, and allowing the pressing member to be located at the press position in the state in which the moving member is located at the second position.

* * * * *